US007618246B2

(12) United States Patent
Frisch et al.

(10) Patent No.: US 7,618,246 B2
(45) Date of Patent: Nov. 17, 2009

(54) ECCENTRIC SCREW PUMP HAVING CONICAL SEALING SURFACES

(75) Inventors: Herbert Frisch, Ampfing (DE); Franz Lachenwitzer, Waldkraiburg (DE); Michael Robby, Muehldorf (DE)

(73) Assignee: Netzsch-Mohnopumpen GmbH (DE)

( * ) Notice: Subject to any disclaimer, the term of this patent is extended or adjusted under 35 U.S.C. 154(b) by 190 days.

(21) Appl. No.: 11/672,446

(22) Filed: Feb. 7, 2007

(65) Prior Publication Data

US 2007/0128062 A1 Jun. 7, 2007

Related U.S. Application Data

(63) Continuation of application No. PCT/DE2005/001301, filed on Jul. 23, 2005.

(30) Foreign Application Priority Data

Aug. 7, 2004 (DE) ..... 10 2004 038 477

(51) Int. Cl.
*F01C 1/10* (2006.01)
*F03C 2/00* (2006.01)
*F04C 18/00* (2006.01)

(52) U.S. Cl. ..... 418/48; 418/116; 418/128; 418/153

(58) Field of Classification Search ..... 418/48, 418/152, 153, 104, 114, 116, 128
See application file for complete search history.

(56) References Cited

U.S. PATENT DOCUMENTS 2,527,670 A * 10/1950 Allen ..... 418/48
4,499,561 A 2/1985 Mason et al. ..... 366/156

FOREIGN PATENT DOCUMENTS

| | | | |
|---|---|---|---|
| DE | 2425055 A | * | 12/1975 |
| DE | 29 37 403 A1 | | 4/1981 |
| DE | 198 04 258 A1 | | 8/1999 |
| DE | 299 09 039 U1 | | 9/1999 |
| DE | 199 09 758 A 1 | | 9/2000 |
| DE | 199 50 257 A 1 | | 4/2001 |
| GB | 2 081 812 A | | 2/1982 |
| SU | 1778368 A1 | | 11/1992 |

OTHER PUBLICATIONS

International Search Report, Sep. 30, 2005, 3 pages.

* cited by examiner

*Primary Examiner*—Theresa Trieu
(74) *Attorney, Agent, or Firm*—St. Onge Steward Johnston & Reens LLC

(57) ABSTRACT

The aim of the invention is to improve the sealing possibilities between the elastic stator lining and corresponding connecting flanges of eccentric screw pumps. In order to increase the sealing surfaces, the stator lining comprises, at least at one of its ends, a conical sealing surface which may be provided with one or more prominent or recessed parts.

9 Claims, 3 Drawing Sheets

ECCENTRIC SCREW PUMP HAVING CONICAL SEALING SURFACES

CROSS-REFERENCE TO RELATED APPLICATIONS

The present application is a continuation of pending International patent application PCT/DE2005/001301 filed on Jul. 23, 2005 which designates the United States and claims priority from German patent application 10 2004 038 477.0 filed on Aug. 7, 2004, the content of which is incorporated herein by reference.

FIELD OF THE INVENTION

The invention proceeds from a stator for eccentric screw pumps with a stator for eccentric screw pumps with an essentially tubular rigid stator casing (18) with an elastic lining (12) essentially uniformly thick over virtually the whole length of the stator (10), said lining having two or more volutions, wherein said lining (12) has at at least one end a sealing surface (26, 28) which is arranged axially at least partially inside the stator casing.

BACKGROUND OF THE INVENTION

There is known from DE 198 04 258 A1 an elastomer stator, which has both a uniformly thick stator casing and an elastomer lining. At at least one of the stator ends, the inner edge of a connecting flange ends flush with the inner surface of the lining. The inner surface of the connecting flange and the sealing surface lying opposing it run parallel to the stator end. The sealing surface is dependent here on the thickness of the stator lining.

DE 29 37 403 A1 shows a device for the sealing of the stator ends with respect to a flange. In all the examples of embodiment, the non-uniformly thick stator lining extends beyond the end of the stator end. The elastomer part projecting beyond the stator end is provided raised in an annular fashion with rounded or flat surfaces. Flat surfaces on the connecting flange that run parallel to the stator end lie opposite the projecting sealing surfaces.

SUMMARY OF THE INVENTION

The problem underlying the invention is to improve the sealing between stators with an elastic lining and connecting flanges or adapters, which are braced together.

According to the invention, the problem is solved according to the features described in the claims.

Developments according to the invention can be found in the description of the invention and in the sub-claims.

DETAILED DESCRIPTION OF THE INVENTION

Figure 1:
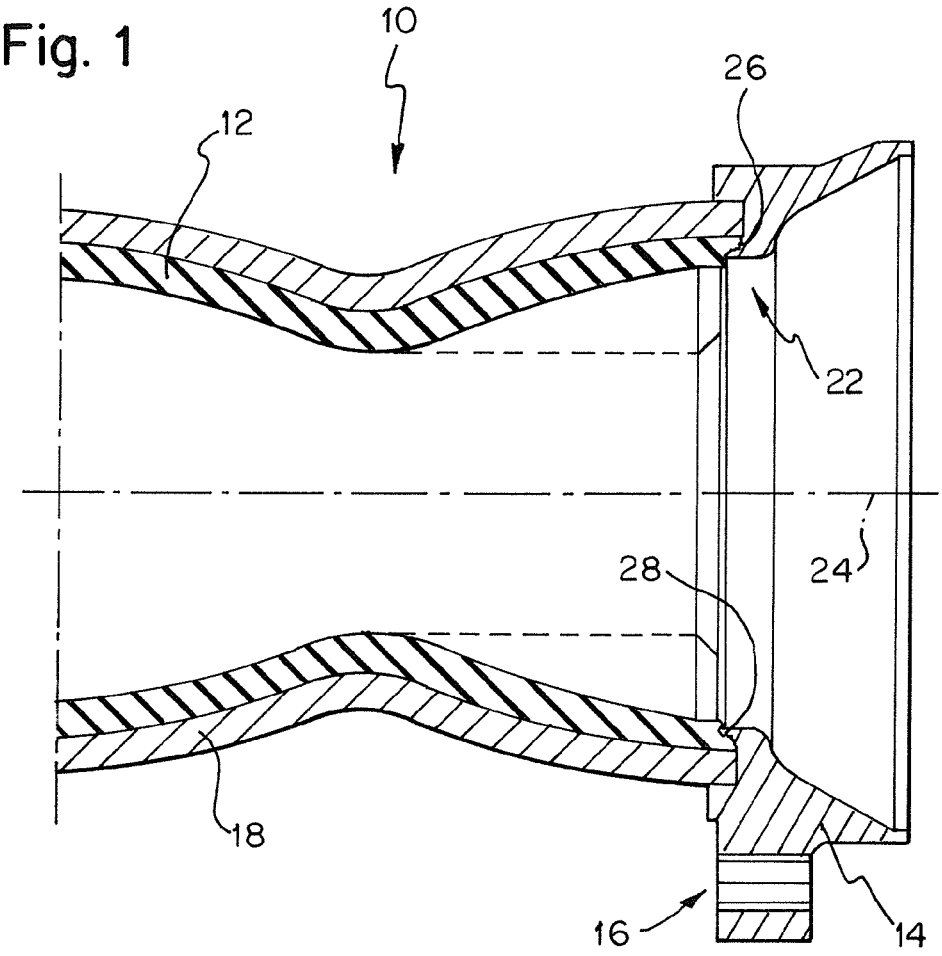
FIG. 1 shows a sectional view of a stator with a flange.

The sealing surface is increased by reason of the conical configuration of the sealing surfaces of the elastomer and the conical complementary configuration of the sealing surfaces of the connecting flange (end flange) and possibly an adapter. This is advantageous especially when the stator lining, which is made from an elastic material such as plastic, e.g. rubber, has a uniformly small thickness virtually over the whole length. However, the small thickness, with its advantages in respect of the small material requirement, good heat transmission value and, for example, small rocking load, would result, according to the prior art, in too small a sealing surface at the end face, insofar as the elastomer layer does not also extend over the end faces of the stator casing and is thereby used as a sealing material or surface.

The application of pressure to the lining material (elastomer) for the purpose of bracing with a flanged-mounted end part or adapter part usually leads in the prior art to permanent material stressing, especially in the transition zone between the stator inner side and end face.

The configuration of the sealing according to the invention thus increases the sealing surface and reduces the mechanical load on the lining in the sealing region. In addition, the risk of damage to the sealing surfaces during transport and during the operation of the pump is reduced, since the sealing region is located at least partially inside the stator.

According to a development of the invention, the sealing surfaces have one or more prominent portions. Complementary to these prominent portions, the sealing surface of the connecting flange has recessed portions in the form of grooves corresponding to the latter. Depending on the cross-section of the stator and the undersized dimension possessed by the lining, the sealing surface and thus the pressure between the stator casing and the elastomer can be increased without damaging the latter.

Depending on the elastomer material of the lining of the stator, it may be advantageous to provide the sealing surfaces with one or more recessed portions. Recessed portions in the form of grooves can lead to a more rapid keyed connection when the stator and the end or adapter flanges are joined together.

According to a further embodiment according to the invention, the sealing surfaces can have threads, by means of which the radial pressing force of the elastomer lining at the inner surface of the stator casing is increased, especially if the conicality of the sealing surface of the connecting flange or the adapter is greater than that of the elastic lining. A load relief of the sealing surface of the lining from the rocking movements produced by the rotor is achieved if the course of the thread between the sealing surfaces between the lining and the flanges/adapters runs in the opposite direction to the direction of rotation of the rotor.

A development of the invention relates to a conical extension of the sealing surfaces, which has no prominent portions and recessed portions and is provided in order to improve the entry of the medium into the stator passages.

A further embodiment of the invention consists in the arrangement of a plurality of annular sub-surfaces which are arranged concentrically with respect to one another. This embodiment facilitates the connection of the stator to the flanges or adapters.

In order to prevent the penetration of medium between the inner side of the stator casing and the elastomer lining, provision can be made such that the lining also extends partially over the end face of the stator casing.

Further details of the invention can be obtained from the examples of embodiment described below.

The end of a stator 10 of an eccentric screw pump shown in FIG. 1 is coated with an elastic lining 12, made from an elastomer or rubber or suchlike. Connecting flanges 14 or adapters are located at the ends of the stator. Connecting flanges 14, for a pump housing or suction housing or pressure housing, are braced with the stator 10 by means of tie-rods for example. For this purpose, suitable tie-rods are passed through holes 16 and provided with an adjustable device. Elastic lining 12 is vulcanised into stator casing 18. Both stator casing 18 and lining 12 have the same thickness or wall thickness over virtually their whole length. Only the thickness of lining 12 changes partially in the region of the stator ends, if a round cross-sectional shape is provided here. Connecting flange 14 can also be an adapter flange, in order to adapt to different transitional cross-sectional shapes. Connecting flange 14 engages around stator casing 18 and rests on end face 20. Inner side 22 of connecting flange 14 extends in the direction of central axis 24 of stator 10 into lining 12. Both lining 12 and connecting flange 14 are shaped conically in this overlapping region. The conically running surfaces of lining 12 and of connecting flange 14 form together sealing surfaces 26, 28.

Figure 2:
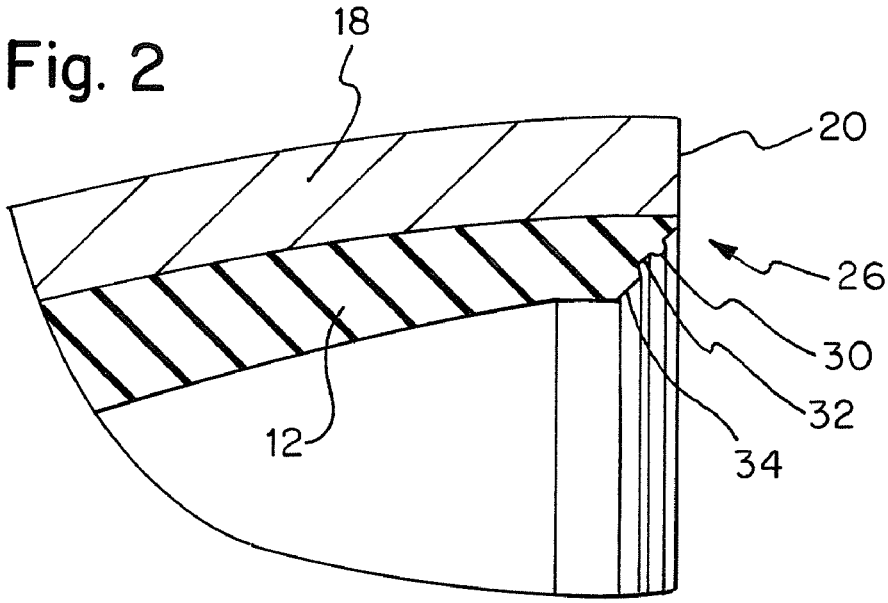
FIG. 2 shows a stator end.

According to FIG. 2, sealing surface 26 has an annular prominent portion 30 and recessed portions 32. The radial inner end of lining 12 is followed by a likewise conically configured surface 34, which improves the inflow of the medium into the stator.

Figure 3:
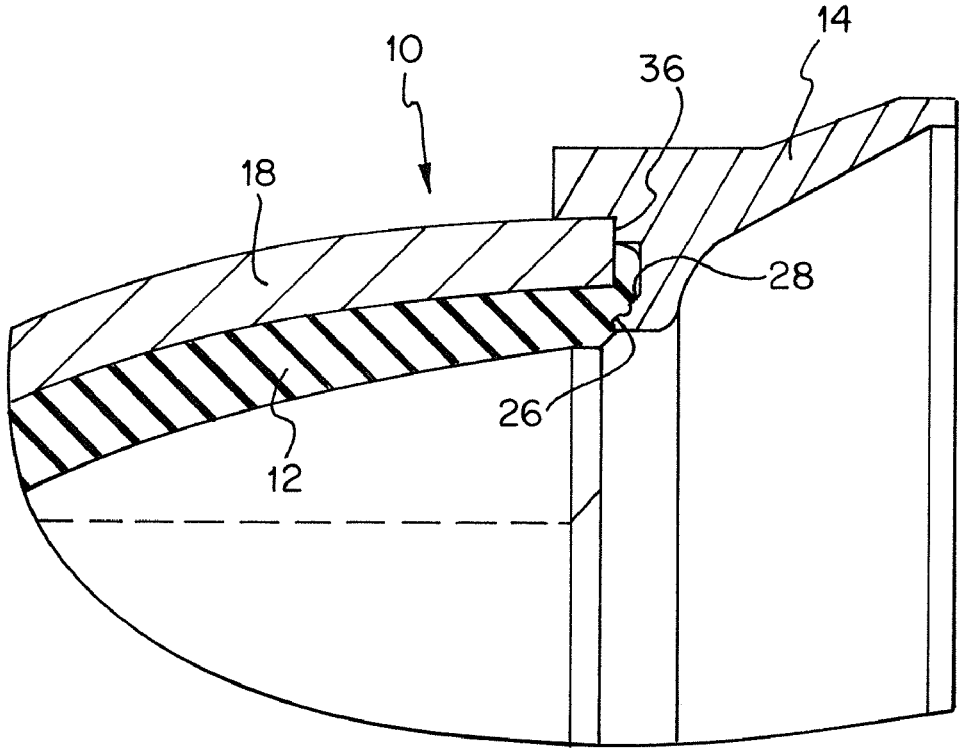
FIG. 3 shows a sectional view of a stator with a flange.

FIG. 3 shows an embodiment of the invention, wherein elastic lining 12 also extends over an end region of end face 20 of stator casing 18. The sealing effect, especially for protection against the penetration medium, between lining 12 and stator casing 18 can thus be increased if need be, since lining 12 overlaps the transition point here. Sealing surfaces 26, 28 of lining 12 and connecting flange 14 consist of a plurality of annular sub-surfaces which may also be arranged in different planes. The connecting flange lies here both directly adjacent to support surface 36 and also to lining 12.

What is claimed is:

1. An eccentric screw pump comprising an essentially tubular rigid stator casing with an elastic lining, said lining being essentially uniformly thick over substantially the whole length of the stator casing, said lining having at least two volutions, wherein at least one end of said lining has a conical sealing surface arranged axially at least partially inside the stator casing, and wherein said conical sealing surface has a complementary sealing surface connected to a flange, and wherein said conical sealing surface and said complementary sealing surface consist of a plurality of sub-surfaces arranged concentrically relative to one another.

2. The eccentric screw pump of claim 1, wherein the sealing surfaces have one or more prominent portions.

3. The eccentric screw pump of claim 1, wherein the sealing surfaces have one or more recessed portions.

4. The eccentric screw pump of claim 1, wherein the conical sealing surface extends only over a part of the thickness of the lining.

5. The eccentric screw pump of claim 1, wherein the surface running conically or parallel to the stator end follows as an extension of the sealing surface in the direction of the longitudinal axis of the stator.

6. The eccentric screw pump of claim 1, wherein said lining has an extension after the conical sealing surface, said extension extending at least partially over the end face of the stator casing.

7. The eccentric screw pump of claim 1, wherein the connecting flange has both a sealing surface and a support surface arranged parallel to the end face.

8. The eccentric screw pump of claim 1, wherein both the sealing surface of the lining and the sealing surface of the connecting flange have threads.

9. The eccentric screw pump of claim 1, wherein the direction of rotation of a rotor is directed against the direction of rotation of a thread formed by the lining and the flange.

* * * * *